US005079860A

United States Patent [19]

Nugent

[11] Patent Number: 5,079,860

[45] Date of Patent: Jan. 14, 1992

[54] FRAME FOR DECORATIVE OBJECTS

[76] Inventor: Rick B. Nugent, R. R. 3, Guttenberg, Iowa 52052

[21] Appl. No.: 482,376

[22] Filed: Feb. 20, 1990

[51] Int. Cl.[5] ..... G09F 1/12

[52] U.S. Cl. ..... 40/155; 40/152; 403/292

[58] Field of Search ..... 40/152, 152.1, 155, 40/611; 403/292, 298, 306; 52/204, 656

[56] References Cited

U.S. PATENT DOCUMENTS

| | | | |
|---|---|---|---|
| 2,259,434 | 10/1941 | Blodgett | 40/154 |
| 2,804,952 | 9/1957 | Nothdurft | 40/152 |
| 3,698,114 | 10/1972 | Hirsch et al. | 40/155 |
| 4,007,552 | 2/1977 | Brooks | 52/656 |
| 4,157,624 | 6/1979 | Sobel | 40/155 |
| 4,368,584 | 1/1983 | Logan | 40/152 |
| 4,557,467 | 12/1985 | Lin | 403/292 |
| 4,630,386 | 12/1986 | wilson | 40/155 |
| 4,662,092 | 5/1987 | Kim | 40/155 |
| 4,718,184 | 1/1988 | Sherman | 40/155 |
| 4,987,709 | 1/1991 | Bucci | 52/656 X |

FOREIGN PATENT DOCUMENTS

| | | | |
|---|---|---|---|
| 55415 | 3/1890 | Fed. Rep. of Germany | 40/152 |
| 2103033 | 8/1971 | Fed. Rep. of Germany | 40/155 |
| 2305571 | 8/1974 | Fed. Rep. of Germany | 40/155 |

*Primary Examiner*—Kenneth J. Dorner
*Assistant Examiner*—Brian K. Green
*Attorney, Agent, or Firm*—Allan L. Harms

[57] ABSTRACT

A reversible curved frame for pictures or other generally planar decorative items. Curved channel segments are joined end to end to form an endless frame. Links received with the channels at the ends thereof retain the segments in joined relationship.

7 Claims, 1 Drawing Sheet

FRAME FOR DECORATIVE OBJECTS

BACKGROUND OF THE INVENTION

This invention relates to frames for decorative items. Traditionally, picture frames and other frames for decorative objects have been constructed of wood, in square and rectangular shapes. Generally such frames having square corners are fixed together by straight or angular abutment or by other well-known wood construction means such as rabbet, dado, or tongue and groove construction.

Metal and plastic frames having square corners are also well-known, including those which are formed into an endless surrounding structure but which require some displaceable structure, usually mounted to the rear of the frame, to retain the object to be displayed within the frame. There exist certain metallic frames which are marketed to the consumer in kit form, wherein the frame is provided in four side pieces with linking hardware to retain the sides together at the corners of the assembled frame. In one form of this type of square-cornered frame, an L-shaped strap is fixed at the legs thereof to the side pieces to be retained together at the corners.

Circular frames or arcuate frames of varying shapes have been developed including an early model such as is taught in U.S. Pat. No. 143,861, which was formed from bands of woods retained by a hoop of lumber rabbeted into the front frame hoop and the rear hoop, to retain the hoops in abutment, and thus the picture to be displayed within the frame would be captured between the front and rear hoops.

U.S. Pat. No. 2,259,434 to Blodgett discloses a frame having interconnecting strap elements which are fixed to each section of the frame and retain the sections together. Blodgett teaches an L-shaped strap to be received in channels on adjoining sidewall sections, as well as an oval frame having a central straightened section, resulting from curved pieces having straightened ends being coupled by a straight linking member. Each straightened end of this device is slidingly engaged with the linking member and latches therewith by spring tongue means engaging a stop face. In the device of Blodgett, the structure creates a frame having a front face and a rear face. The object to be mounted in the frame may only be viewed from the front thereof, in this form of device.

SUMMARY OF THE INVENTION

The present invention relates to circular or otherwise arcuate frames for the enclosure of the edges of curved artworks, including for example, but not by way of limitation, a work of art in stained glass, or another ornamental object where view from either side thereof may be desired.

An endless loop is formed from a plurality of extruded metal segments, the resulting loop having an annular channel therewithin wherein the edges of the object to be displayed may be received. The segments are abutted at the ends thereof and retained in abutment by link members which are received within recesses in the channels of said segments. Said link members are retained to the segments by detachable means. The segments comprising the endless loop may be of continuous or varying curvature, and they may have, but need not have, straightened portions therealong. A straightened section is not required, however, due to the novel interconnection structure of this device.

Anodized aluminum may be used for the segment material, which provides a decorative frame in varying colors without the need for added painting, while the attractiveness of the metal parts remains visible in order to complement the ornamental item to be displayed, as desired.

One object of the invention is to provide a continuously acruate frame for ornamental objects.

Another object of the invention is to provide an arcuate frame which can be manufactured from extruded metals.

Another object of the invention is to provide an arcuate enclosing frame which may display an ornamental object from either side.

Another object of the invention is to provide an arcuate frame which can be made of anodized aluminum.

These and other objects of the invention will be apparent from the detailed description which follows.

DESCRIPTION OF THE DRAWING FIGURES

DETAILED DESCRIPTION OF THE INVENTION

Figure 1:
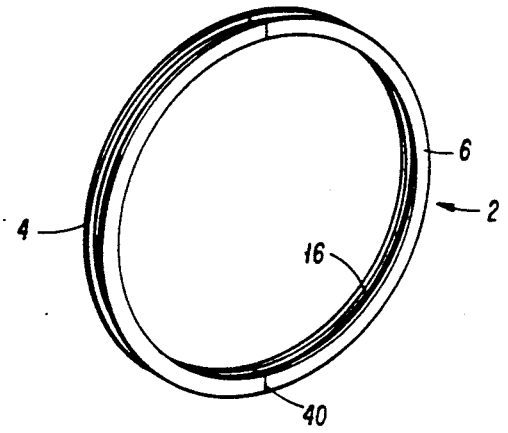
FIG. 1 is a perspective view of the invention.
Figure 2:
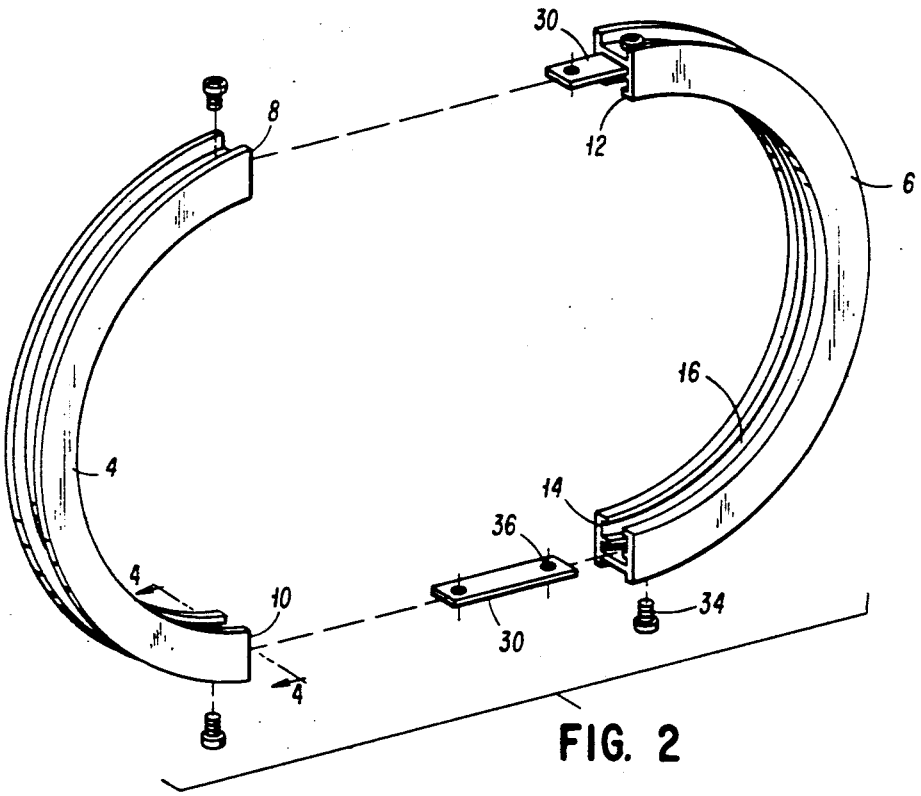
FIG. 2 is an exploded perspective view of the elements of the invention.

FIGS. 1 and 2 of the drawings disclose the invention 2 as an endless arcuate loop, comprising a plurality of arcuate elongated segments 4 and 6. Segments 4 and 6 are shown in FIG. 2 to be identical in configuration, and in the preferred embodiment, segments 4 and 6 are semicircular in curvature, forming, when abutted at the ends thereof, a circular endless loop frame 2. It is to be understood that frame 2 could be made of more than two segments provided that when such plurality of segments were abutted end to end, the plurality of segments would create an endless arcuate loop. It is also to be remembered that the curvature of segments 4 and 6 need not be continuous, provided that the ends of each of segments 4 and 6 will abut. By the use of other curvatures for segments 4 and 6, or of other pluralities of segments having nonuniform radii of curvature, frame 2 may be of other endless loop configurations including elliptic or other nonuniform arcuate shapes.

Segment 4 is provided with opposing ends 8 and 10. Segment 6 is provided with opposing ends 12 and 14. Segment 4 is joined to segment 6 such that end 8 of segment 4 abuts end 12 of segment 6 and end 10 of segment 4 abuts end 14 of segment 6. When so abutted at the ends thereof, segments 4 and 6 cooperate to create an endless loop having annular channel 16 therein.

Figure 4:
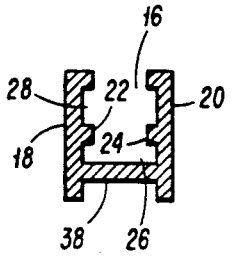
FIG. 4 is a cross section taken along line 4—4 of FIG. 2.

Annular channel 16 can best be visualized in FIG. 4 where a cross section of segment 6 is shown. Segments 4 and 6 can be manufactured from numerous acceptable materials and in the preferred embodiment, extruded aluminum is used. Lengths of straight extruded aluminum channel can be formed into the arcuate forms desired, and such aluminum may be anodized to provide aesthetically pleasing metallic coloration.

Referring again to FIG. 4, channel 16 is generally U-shaped and is formed between first sidewall 18 and second sidewall 20 of segments 4 and 6. Channel 16 is narrowed due to encroachment of flanges 22 and 24 thereinto, thereby producing compartments 26 and 28 therewithin. Compartment 26 provides a receiving slot into which an end of link members 30 may be placed. It can be easily seen that horizontal symmetry of the cross section of segment 6 as displayed in FIG. 4 will allow the insertion of a suitable link 30 within compartment 26, regardless of the specific arcuate configuration of the segment. Each link member 30 is partially slidably received within the respective compartment 26 of segments 4 and 6. Specifically, link member 30 is placed into compartment 26 of channel 16 at end 12 of segment 6 and at end 8 of segment 4. Similarly, another link 30 may be received by end 14 of segment 6 and by end 10 of segment 4. Link members 30 are arcuately configured to conform to the curvature of segments 4 and 6 and are provided with threaded holes such as hole 36 into which screw 34 may be transmitted after its passage through a suitably placed opening within transverse bar 38 of segment 4 or 6. When end 8 of segment 4 is in abutment with end 12 of segment 6, holes of link member 30 will be generally concentric with holes in transverse bar 38 of segments 4 and 6, thereby permitting screws 34 to pass through bar 38 and into a hole 36 of link member 30.

Figure 3:
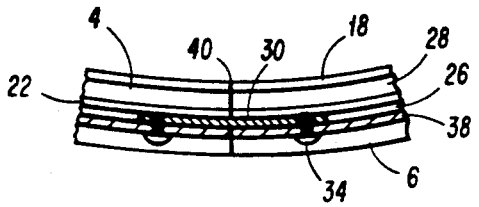
FIG. 3 is a longitudinal cross section view of a portion of the invention surrounding the area of abutment of segments of the invention.

Referring now to FIG. 3, it can be seen that segments 4 and 6 are abutted at juncture 40. Link 30 has been received within compartment 26 such that it is retained in position by the cooperation of sidewall 18, transverse bar 38, sidewall 20, and flanges 22 and 24. Screws 34 pass through transverse bar 38 and are threadingly received within hole 36 of link member 30. A decorative object to be retained in frame 2 will be placed such that its edge will rest within compartment 28 of channel 16 and the decorative object will be retained by sidewalls 18 and 20 of segments 4 and 6. It is obvious that the symmetry of segments 4 and 6 will permit such a retained object to be viewable from either side thereof. A work of art such as a double-faced mirror, or a stained glass work, or some other work intended to be viewed from either side, will thereby be properly retained and appropriately attractively displayed in frame 2.

It should be further be remembered that the exact dimensions and configurations of the cross section of segments 4 and 6 may vary without departing from the scope of the invention.

Having described the invention, I claim:

1. A frame for display of generally planar objects of artwork, comprising an endless loop comprising a plurality of two-ended segments joined together at the ends thereof, each of said segments comprising a curved elongated channel, said segments being joined by link members, said link members being generally elongate, said link members being longitudinally arcuate and receivable within said channel, said channel having a cross section which is horizontally symmetrical, said channel comprises in cross section a transverse bar having edges from which depend generally parallel sidewalls, said sidewalls having first flanges extending inwardly therefrom in opposing arrangement, said first flanges are positioned generally medially along the lengths of said sidewalls, said first flanges extending longitudinally along said channels of said segments, said sidewalls, said first flanges and said transverse bar comprising a first compartment into which said link members are receivable, said sidewalls each having a second flange depending generally inwardly, said second flanges and said sidewalls comprising a second compartment into which the object of artwork may be received, said link members having threaded openings therealong, said bar of said channel having openings therethrough generally coaxial with said threaded openings of said link members when said link members are received in said first compartments of said channels, a plurality of screws each receivable within the opening in said bar of said channel and engageable with the threaded opening of said link members.

2. The frame of claim 1 wherein said segments are formed from extruded aluminum.

3. A frame for peripherally surrounding works of stained glass having curvilinear edges, comprising a plurality of arcuate elongate side members abutted together and defining an arcuate loop, a plurality of elongated arcuate segments of relatively short length relative to said side members and interconnectable with said side members, said side members being of a given cross section and defining an annular recess for receiving the edges of a work of stained glass, said side members further defining an annular compartment for receiving said arcuate segments, said annular recess being generally concentric to said annular compartment, said cross section of said side members being horizontally symmetrical, comprising a U-shape having sides interconnected by a bar, each of said sides of said cross section of said side members having an inwardly depending first flange therealong, said first flanges of said sides in opposing relationship, said first flanges of said sides, said sides, and said bar defining said annular compartment, said arcuate segments having threaded openings therealong, said bar having openings therethrough generally coaxial with said threaded openings of said arcuate segments when said arcuate segments are received in said annular compartment, a plurality of screws each receivable within the openings in said bar and engageable with the threaded openings of said arcuate segments.

4. The frame of claim 3 wherein said sides having second flanges positioned therealong, spaced apart from said first flanges, said second flanges in opposing relationship upon said sidewalls, said second flanges, said sidewalls, and said first flanges defining said annular recess.

5. The frame of claim 4 wherein said side members are formed from extruded aluminum.

6. The frame of claim 3 wherein said side members having oversized openings therewithin coaxial with said threaded openings of said arcuate segments when said arcuate segments are received in said segment-receiving compartment, said screws pass through said oversized openings and engage said threaded openings of said arcuate segments.

7. The frame of claim 6 wherein said side members are formed from extruded aluminum.

* * * * *